US005697029A

United States Patent [19]

Saitoh et al.

[11] Patent Number: 5,697,029

[45] Date of Patent: Dec. 9, 1997

[54] MAGNET DEVELOPING ROLLER WITH DRY PLATED SLEEVE

[75] Inventors: Shinji Saitoh; Masato Yoshikawa, both of Kodaira; Kazuo Naito, Kawasaki; Kanji Inoue, Higashiyamato, all of Japan

[73] Assignee: Bridgestone Corporation, Tokyo, Japan

[21] Appl. No.: 623,221

[22] Filed: Mar. 28, 1996

[30] Foreign Application Priority Data

Apr. 11, 1995 [JP] Japan ..... 7-085630
Apr. 28, 1995 [JP] Japan ..... 7-105246

[51] Int. Cl.[6] ..... G03G 15/08

[52] U.S. Cl. ..... 399/286; 399/276; 399/279

[58] Field of Search ..... 355/251, 253, 355/245; 118/657, 658; 430/122; 399/222, 265, 267, 276, 279, 286

[56] References Cited

U.S. PATENT DOCUMENTS 4,930,438 6/1990 Demizu et al. .
4,989,044 1/1991 Nishimura et al. .
5,164,780 11/1992 Ohno et al. .
5,353,104 10/1994 Kato et al. .

*Primary Examiner*—Sandra L. Brase
*Attorney, Agent, or Firm*—Sughrue, Mion, Zinn, Macpeak & Seas, PLLC

[57] ABSTRACT

A developing roller includes a magnet roller and a rotatable sleeve thereon. The sleeve is covered with a surface coating of a metal, alloy, metal nitride, metal oxide, metal carbide or metal sulfide by dry plating. The coating has a resistivity of up to 0.01 Ωcm. The sleeve is fully wear resistant at its surface. Formation of the coating by dry plating minimizes the variation of coating thickness to improve the dimensional precision of the sleeve surface. The developing roller and a developing apparatus equipped therewith can produce images of quality for a long time.

14 Claims, 1 Drawing Sheet

MAGNET DEVELOPING ROLLER WITH DRY PLATED SLEEVE

BACKGROUND OF THE INVENTION

1. Field of the Invention

This invention relates to a developing roller and developing apparatus for use in electrophotographic machines such as copiers, printers, and facsimile machines.

2. Prior Art

Electrophotographic printing machines such as copiers, laser beam printers, and facsimile machines use a developing roller for conveying a developer such as toner and carrier. In most cases, the developing roller includes a magnet roller as means for generating a magnetic field and a cylindrical sleeve of non-magnetic metal fitted thereon for rotation.

The metallic sleeve is typically formed of aluminum alloys and stainless steel alloys. Particularly a sleeve of aluminum alloy, which is a relatively soft metal, has the problem that the sleeve is worn out during long-term service by rubbing contact with the developer, blade and developer-conveying roller in the developing apparatus. The worn sleeve is deleterious to the functions of conveying the developer and electric charging and for a particular type of developer, can cause an image defect known as ghost development (that is, re-development of a residual image) as described in Japanese Patent Application Kokai (JP-A) No. 306274/1990. Sometimes the sleeve on the surface is provided with ultrafine asperities to an appropriate roughness in order to improve the functions of developer conveyance and electric charging for producing images of quality. In this case, the ultrafine asperities are altered by wear during long-term service, failing to produce images of quality.

It was proposed in JP-A 41485/1991 to provide the sleeve of aluminum alloy or stainless steel alloy with a plated coating of a material different from the matrix for the purpose of improving the wear resistance of the sleeve at its surface. In the case of electrical plating, however, a coating must be formed on the sleeve to a thickness of more than several microns in order to improve the wear resistance of the sleeve. When plated to a thickness of this order, the coating is uneven in thickness. The sleeve thus has a lower dimensional precision, leading to a lowering of image quality.

SUMMARY OF THE INVENTION

An object of the present invention is to provide a developing roller including a sleeve whose surface is improved in wear resistance at no sacrifice of its dimensional precision so that images of quality can be produced for a long time without re-development of a residual image.

The present invention provides a developing roller comprising a magnet roller and a cylindrical sleeve disposed for rotation around the magnet roller. A coating is formed on an outer Surface of the sleeve by dry plating. The coating is based on a metal, alloy, metal nitride, metal oxide, metal carbide or metal sulfide. The coating has a resistivity of up to 0.01 Ωcm at 20° C. A developing apparatus comprising the developing roller is also contemplated herein.

The developing roller of the invention including a sleeve covered with a coating composed mainly of a metal, alloy, metal nitride, metal oxide, metal carbide or metal sulfide has the advantage that the sleeve itself maintains the initial surface state without wearing away for a long term of service because the coating has a relatively high hardness. Also the quality of developed images is not deteriorated because the coating has a resistivity of up to 0.01 Ωcm at 20° C. Since the coating is formed by dry plating, the coating thickness has a minimized variation and the eliminated use of solution is advantageous for the environment and hygiene.

BRIEF DESCRIPTION OF THE DRAWINGS

These and further features of the present invention will be apparent with reference to the following description and drawings, wherein.

The only FIGURE.

DETAILED DESCRIPTION OF THE INVENTION

Figure 1:
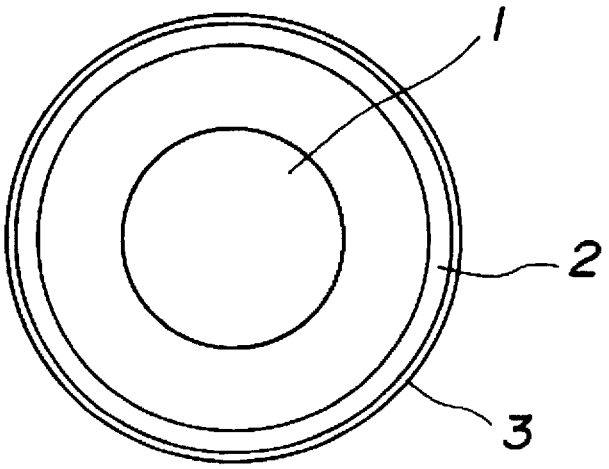
FIG. 1 is a schematic cross-sectional view of a developing roller according to one embodiment of the invention.

Referring to FIG. 1, there is shown a developing roller according to one embodiment of the invention. The developing roller includes a magnet roller 1, a cylindrical sleeve 2, and a coating 3. The sleeve 2 is concentrically disposed around the periphery of the magnet roller 1 for free rotation about a common axis. The coating 3 is formed on an outer surface of the sleeve 2. The coating 3 preferably has a radial thickness of 0.2 to 3 μm. A coating with a thickness of less than 0.2 μm would be insufficient to improve wear resistance. A coating with a thickness of more than 3 μm would be susceptible to separation and cracking due to increased internal stresses, add to the cost, and tends to alter its surface state when the sleeve surface is provided with ultrafine asperities.

The magnet roller 1 may be formed of any desired material. Bonded magnets and sintered magnets are typically used, with the bonded magnets being preferred for ease of molding.

The sleeve 2 may be formed of any desired material. Metallic materials such as aluminum alloys, stainless steel alloys, and copper alloys are typically used as well as resins. Among these, aluminum alloys are preferred for material cost and ease of working.

The sleeve 2 has an outer surface. For improving image quality, surface blasting is preferably carried out before the coating 3 is formed thereon although the invention is not limited thereto. More particularly, the sleeve surface may be blasted to form ultrafine asperities to provide a mean surface roughness of about 0.05 to 50 μm by ten point height of irregularities (Rz), which is defined in ISO R 468. The blasting treatment may be done by pressure or suction air blasting, vacuum blasting, water blasting, and centrifugal blasting. Any desired grit may be used in blasting, for example, cast iron grits, steel grits, copper slag, nickel slag, fused alumina, and silicon carbide. When it is desired to polish and clean the surface of the sleeve for the purpose of increasing its bond to the overlying coating, there may be used glass beads, plastic beads, sand and walnut shell flour. The pressure, distance, angle and other parameters of blast treatment are not critical and may be chosen in accordance with the desired ultrafine asperity shape and degree of surface polishing.

Apart from the blast treatment, the sleeve 2 may be pretreated on its surface before formation of the coating 3 thereon for the purpose of improving the adhesion between the sleeve 2 and the coating 3. The pretreatment may be done by solvent washing, acid or alkali washing, water washing, flame treatment, corona discharge treatment, and plasma treatment. Water washing and plasma treatment are preferred because these treatments are more effective and the disposal of used solution is unnecessary. Plasma treatment is most preferred as the pretreatment before formation of the coating 3 by dry plating. Typically plasma treatment is carried out at the pressure of 1 to 100,000 Pa in the atmosphere of argon, oxygen, nitrogen, air, helium, their mixture, etc. by applying electrical field of DC or AC.

The coating 3 formed on the outer surface of the sleeve 2 is made of a material containing more than 50% by weight, preferably more than 80% by weight of at least one member selected from the group consisting of a metal, alloy, metal nitride, metal oxide, and metal carbide. Examples of the metal include chromium, molybdenum, titanium, zinc, and tungsten; examples of the alloy include copper-aluminum alloys and stainless steel alloys; an exemplary metal nitride is titanium nitride; examples of the metal oxide include tin oxide, tin oxide-indium oxide complexes, and molybdenum dioxide; and examples of the metal carbide include titanium carbide and molybdenum carbide. Among these, chromium, copper-aluminum alloys, stainless steel alloys, and titanium nitride are preferred because wear resistant coatings can be formed at a relatively low cost. Also metals, ceramics or metal-ceramic mixtures containing at least 50% by weight, preferably at least 80% by weight of tungsten are preferably used as the coating 3. It is noted that the coating 3 may contain a ceramic component such as insulating oxides and insulating nitrides and a particulate organic component such as polytetrafluoroethylene and polyethylene.

The coating 3 should have a resistivity of up to 0.01 Ωcm at 20° C. because no good development quality is otherwise achieved. The coating 3 may have a layered structure consisting of two or more layers made of the above-mentioned materials.

A dry plating method capable of forming a uniform high density thin film is used to form the coating 3. The dry plating method encompasses physical vapor deposition (PVD) such as vacuum evaporation, ion plating and sputtering and chemical vapor deposition (CVD). Sputtering and ion plating are preferred because high-boiling metals, alloys, metal nitrides, metal oxides, metal carbides or metal sulfides can be applied in a relatively simple manner to form a coating of quality which firmly adheres to the underlying sleeve 2 and is resistant to wear. Sputtering is most preferred because of a low cost and the following advantages. Even when the coating is relatively thin, the variation of coating thickness is minimized. Particularly when the matrix or sleeve 2 on the surface is provided with minute asperities, the leveling effect that the minute asperities are reflected to a little extent or not reflected at all on the coating 3 is minimized. There can be formed a coating of uniform thickness and satisfactory step coverage.

The sputtering may be carried out by any of commonly used techniques. For example, magnetron sputtering which may be of either DC or high-frequency mode is advantageously used. Bias sputtering and reactive sputtering are also useful. In the case of DC magnetron sputtering, a coating of quality can be formed on the sleeve surface using a conductive target made of a metal, alloy or a composite of different metals or alloys, an argon gas atmosphere of 0.1 to 100 Pa, and a DC output of 1 to 15 Watts per square centimeters.

These dry plating methods can form uniform coatings of firm bond as compared with wet plating methods such as electric plating and electroless plating. Additionally, the dry plating methods are free of the environment or hygiene hazard caused by the used solution associated with the wet plating methods.

EXAMPLE

Examples of the present invention are given below by way of illustration and not by way of limitation.

COMPARATIVE EXAMPLE 1

Several pipes having an outer diameter of 30 mm, a gauge of 1.5 mm, and a length of 300 mm were prepared from aluminum alloy 5052. The pipes on the outer surface were treated by pressure air blasting with Alundum #46, thereby adjusting the surface to a mean roughness Rz of 18 μm. Note that the mean surface roughness Rz is an average of measurements at four different points in both circumferential and axial directions (rounding at micron). One of the blasted pipes is designated sleeve A.

EXAMPLE 1

One of the blasted pipes in Comparative Example 1 was subject to ultrasonic washing in pure water and dried in hot air. It was then contacted for 5 minutes with a plasma discharge in an argon atmosphere of 50 Pa by applying a high-frequency output of about 0.2 W/cm$^2$ at 13.56 MHz. Thereafter, a coating was formed on the pipe surface by DC magnetron sputtering. That is, by sputtering a target of 99.9% purity chromium in an argon gas of 1 Pa, a coating of 0.45 to 0.47 μm was formed. The coating had a surface roughness Rz of 18 μm and a resistivity of 0.00001 Ωcm. The coated pipe is designated sleeve B.

It is noted that the sputtering method in Examples 1 to 4 used a plate target of 400 mm long and 100 mm wide and a sputtering gun having a planar magnetic circuit. The pipe was held with its center axis spaced 50 mm apart from the target surface. The pipe was rotated during deposition, thereby forming a coating which was uniform in a circumferential direction. A DC output was 0.25 to 0.27 kW. The thickness of a coating was controlled in terms of the depositing time. Resistivity was measured by a four-terminal network method on a coating which was formed on a glass plate under the same conditions.

EXAMPLE 2

As in Example 1, a coating of 0.24 to 0.26 μm was formed on the pipe by sputtering a target of 99.9% purity molybdenum in an argon gas of 0.5 Pa. The coating had a surface roughness Rz of 18 μm and a resistivity of 0.00003 Ωcm. The coated pipe is designated sleeve C.

EXAMPLE 3

As in Example 1, a coating of 0.8 to 0.83 μm was formed on the pipe by sputtering a target of a copper-aluminum alloy containing 40% by weight of copper in an argon gas atmosphere of 4 Pa. The coating had a surface roughness Rz of 17 μm and a resistivity of 0.00001 Ωcm. The coated pipe is designated sleeve D.

EXAMPLE 4

As in Example 1, a coating of 0.9 to 0.95 μm was formed on the pipe by sputtering a target of stainless steel SUS304 in an argon gas of 0.5 Pa. The coating had a surface roughness Rz of 17 μm and a resistivity of 0.00001 Ωcm. The coated pipe is designated sleeve E.

COMPARATIVE EXAMPLE 2

As in Example 1, a coating of 0.3 to 0.32 μm was formed on the pipe by sputtering a target of quartz glass (silicon dioxide) in an argon gas of 1 Pa. The coating had a surface roughness Rz of 18 μm. Its resistivity could not be measured because it was above 0.1 Ωcm. The coated pipe is designated sleeve F.

Developing test

A developing roller was manufactured by inserting a magnet roller of an appropriate size through the sleeve, and mating caps to the sleeve ends. The developing roller was mounted in a laser beam printer, which was operated to continuously print a test pattern containing sections of lines at five different pitches of 0.1 mm to 3 mm. When 5,000, 15,000, and 40,000 sheets were printed, the developing roller was removed and measured for roughness on the sleeve surface. The results are shown in Table 1.

TABLE 1

| | Surface roughness Rz (μm) after the number of printed sheets reached | | | |
|---|---|---|---|---|
| Sleeve | 0 | $5 \times 10^3$ | $15 \times 10^3$ | $40 \times 10^3$ |
| A | 18 | 6 | 2 | 1 |
| B | 18 | 17 | 15 | 13 |
| C | 18 | 17 | 17 | 15 |
| D | 17 | 15 | 12 | 9 |
| E | 17 | 15 | 13 | 10 |

The printed test pattern was observed at suitable intervals. For the developing roller equipped with sleeve A, the printed test pattern was found to be disordered after the number of printed sheets exceeded 5,000. For the developing rollers equipped with sleeves B, C, D, and E, no lowering of print quality was observed until the number of printed sheets reached 40,000, that is, the end of the test. It is noted that for the developing roller equipped with sleeve F, no clear print image was obtained from the first.

EXAMPLE 5

As in Example 1, a coating of 0.45 to 0.47 μm was formed on the pipe by sputtering a target of 99.9% purity tungsten in an argon gas of 1 Pa. The coating had a surface roughness Rz of 18 μm and a resistivity of 0.00001 Ωcm. The coated pipe is designated sleeve G. The sleeve was assembled into a developing roller, which was similarly tested. The results are shown in Table 2.

TABLE 2

| | Surface roughness Rz (μm) after the number of printed sheets reached | | | |
|---|---|---|---|---|
| Sleeve | 0 | $5 \times 10^3$ | $15 \times 10^3$ | $40 \times 10^3$ |
| A | 18 | 6 | 2 | 1 |
| G | 18 | 17 | 15 | 14 |

The printed test pattern was observed at suitable intervals. For the developing roller equipped with sleeve A, the printed test pattern was found to be disordered after the number of printed sheets exceeded 5,000. For the developing roller equipped with sleeve G, no lowering of print quality was observed until the number of printed sheets reached 40,000, that is, the end of the test.

There has been described a developing roller including a sleeve covered with a surface coating composed mainly of a metal, alloy, metal nitride, metal oxide, metal carbide or metal sulfide. The sleeve is fully wear resistant at its surface. The developing roller and the developing apparatus equipped therewith can produce images of quality without re-development of a residual image. Since the coating was formed by dry plating, the variation of coating thickness is minimized and the dimensional precision of the sleeve at the surface is improved.

Although some preferred embodiments have been described, many modifications and variations may be made thereto in the light of the above teachings. It is therefore to be understood that within the scope of the appended claims, the invention may be practiced otherwise than as specifically described.

We claim:

1. A developing roller comprising a magnet roller, a sleeve disposed for rotation around said magnet roller, and a coating formed on an outer surface of said sleeve by a dry plating method, said coating consisting of at least one member selected from the group consisting of a metal, alloy, metal nitride, metal oxide, metal carbide, and metal sulfide and having a resistivity of up to 0.01 Ωcm at 20° C.

2. The developing roller of claim 1 wherein said coating is formed of at least one member selected from the group consisting of chromium, a copper-aluminum alloy, stainless steel alloy, and titanium nitride.

3. The developing roller of claim 1 wherein said coating is formed of tungsten.

4. The developing roller of claim 1 wherein said coating has a thickness of 0.2 to 3 μm.

5. The developing roller of claim 1 wherein said dry plating method is sputtering.

6. The developing roller of claim 1 wherein said sleeve is formed of an aluminum alloy.

7. The developing roller of claim 1 wherein the outer surface of said sleeve on which said coating is formed has ultrafine asperities.

8. A developing apparatus for an electrophotographic device comprising; a developing roller which comprises a magnet roller for generating a magnetic field, a non-magnetic sleeve disposed for rotation around said magnet roller, and a coating formed on an outer surface of said sleeve by a dry plating method, said coating consisting of at least one member selected from the group consisting of a metal, alloy, metal nitride, metal oxide, metal carbide, and metal sulfide and having a resistivity of up to 0.01 Ωcm at 20° C.

9. The developing apparatus of claim 8 wherein said coating is formed of at least one member selected from the group consisting of a chromium, copper-aluminum alloy, stainless steel alloy, and titanium nitride.

10. The developing apparatus of claim 8 wherein said coating is formed of tungsten.

11. The developing apparatus of claim 8 wherein said coating has a thickness of 0.2 to 3 μm.

12. The developing apparatus of claim 8 wherein said dry plating method is sputtering.

13. The developing apparatus of claim 8 wherein said sleeve is formed of an aluminum alloy.

14. The developing apparatus of claim 8 wherein the outer surface of said sleeve on which said coating is formed has ultrafine asperities.

* * * * *